US007654651B2

(12) United States Patent
Shiki

(10) Patent No.: US 7,654,651 B2
(45) Date of Patent: Feb. 2, 2010

(54) LIQUID DISCHARGE HEAD AND MANUFACTURING METHOD OF THE SAME

(75) Inventor: Mika Shiki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 417 days.

(21) Appl. No.: 11/612,844

(22) Filed: Dec. 19, 2006

(65) Prior Publication Data

US 2007/0165081 A1 Jul. 19, 2007

(30) Foreign Application Priority Data

Jan. 17, 2006 (JP) ..... 2006-008146

(51) Int. Cl.
*B41J 2/045* (2006.01)

(52) U.S. Cl. ..... 347/70

(58) Field of Classification Search ..... 347/70, 347/68–69, 71–72; 400/124.16
See application file for complete search history.

(56) References Cited

U.S. PATENT DOCUMENTS 5,530,465 A 6/1996 Hasegawa et al.
6,336,717 B1 1/2002 Shimada et al.
6,345,424 B1 2/2002 Hasegawa et al.
6,502,928 B1 1/2003 Shimada et al.

FOREIGN PATENT DOCUMENTS

JP 11-291495 A 10/1999
JP 11-300971 A 11/1999
JP 2000-272126 A 10/2000
JP 3379538 B 12/2002

*Primary Examiner*—K. Feggins
(74) *Attorney, Agent, or Firm*—Fitzpatrick, Cella, Harper & Scinto

(57) ABSTRACT

In a liquid discharge head having a vibration plate provided with piezoelectric driving sections and a substrate which supports the vibration plate and in which pressure generating chambers communicating with discharge ports to discharge a liquid are arranged to correspond to the piezoelectric driving sections, at a region of an end portion of each pressure generating chamber in a longitudinal direction, a portion of the substrate on a side of the vibration plate protrudes along the longitudinal direction to the pressure generating chamber in a stepped state.

4 Claims, 6 Drawing Sheets

LIQUID DISCHARGE HEAD AND MANUFACTURING METHOD OF THE SAME

BACKGROUND OF THE INVENTION

1. Field of the Invention

The present invention relates to a liquid discharge head which includes discharge ports to discharge liquid droplets and separate liquid chambers connected to the discharge ports and in which a displacement is applied to a vibration plate disposed to face each separate liquid chamber and constituting a part of the chamber to thereby discharge the liquid droplets, and a manufacturing method of the liquid discharge head. The liquid discharge head of the present invention is applicable to a recording unit which prints information on paper, cloth, leather, nonwoven cloth, OHP sheet or the like, a patterning unit which attaches a liquid to a solid such as a substrate or a plate material, a coating unit or the like.

2. Description of the Related Art

Liquid discharge heads have heretofore been incorporated broadly in recording units such as a printer and a facsimile machine for reasons such as a low noise, a low running cost and ease of miniaturizing and coloring of a unit. Especially, the liquid discharge head using a piezoelectric actuator enlarges its application as a patterning unit for device manufacturing owing to a high degree of freedom in selecting a liquid to be discharged.

There will specifically be described a process in which the liquid is discharged from discharge ports in the liquid discharge head using the piezoelectric actuator. First, an electric signal is supplied to thereby apply a displacement which changes with time to a vibration plate constituting a part of each separate liquid chamber, thereby contracting or expanding a volume of the separate liquid chamber. When such a volume control is performed, the liquid having a liquid column state starts to extend and protrude to the outside. Subsequently, while a plurality of liquid droplets are separated from one another by a surface tension, the droplets fly through, for example, a gap between a recording head (the liquid discharge head) and a recording material. On the other hand, in the application as either the recording unit or the patterning unit, achievements of a high resolution of nozzle arrangement and a micro amount of the discharged liquid droplets are advanced. Moreover, increase of a liquid droplet shot precision is achieved. Above all, as a main method of increasing the resolution, decreasing of a width of the separate liquid chamber is investigated.

In a case where the width of the separate liquid chamber is decreased to thereby increase the resolution, a displacement efficiency needs to be improved in order to realize desired discharge performances such a discharge amount and a discharge speed. To solve the problem, as a measure, decreasing of a thickness of the vibration plate is known (see Japanese Patent Application Laid-Open Nos. H11-291495 and H11-300971).

However, as a result of specific investigations of the present inventor, the following technical problems have been clarified in a case where the thickness of the vibration plate is decreased as much as possible.

An investigation object is a unimorph type (a vendor type) piezoelectric recording head in which the vibration plate is provided with piezoelectric articles as piezoelectric driving sections and electrodes. Several types of piezoelectric recording heads are prepared by changing the thickness of each vibration plate to compare discharge lives. Here, as a criterion for judging the life, a time when the vibration plate cracked is regarded as a liquid leak generation time in a vibration plate portion, and the life is evaluated by the number of discharge operations up to that time. As easily expected, the thinner vibration plate has a shorter life owing to the crack of the vibration plate.

Moreover, when a displacement amount of the vibration plate is measured in a longitudinal direction of a separate liquid chamber in one element of the unimorph type piezoelectric recording head, the following tendency is observed.

FIG. 8 is a sectional view of the unimorph type piezoelectric recording head. A separate liquid chamber 105 has a length of 2.5 mm. When a voltage is applied to a piezoelectric element 106, a vibration plate 107 deforms. FIG. 9 plots the displacement amount of the vibration plate 107 in the longitudinal direction of the separate liquid chamber at a certain time after the voltage is input.

Curves $T_1$, $T_2$ and $T_3$ show that the vibration plate 107 deforms, when time t elapses to t1, t2 and t3. However, it is seen that the displacement amount of the vibration plate 107 largely fluctuates at opposite end regions of the separate liquid chamber 105, that is, in the vicinity of a discharge port 102 and at an end portion on a common liquid chamber side as compared with another place.

When the displacement amount of the vibration plate peculiarly fluctuates more largely at the end portions on a discharge port side and the common liquid chamber side than in another large region, destruction or crack of the vibration plate easily occurs at the end portions. It has been seen that the vibration plate end portions on the discharge port side and the common liquid chamber side further easily crack especially in a case where the vibration plate is thinned.

SUMMARY OF THE INVENTION

The present invention has been developed in view of unsolved problems of the above-described conventional technology, and an object thereof is to provide a liquid discharge head and a manufacturing method of the head in which a vibration plate is prevented from being cracked to extend a life and which has a sufficient discharge life with a high resolution.

A liquid discharge head of the present invention comprises: a vibration plate provided with a piezoelectric driving section; and a substrate which supports the vibration plate and in which a pressure generating chamber communicating with a discharge port to discharge liquid is arranged to correspond to the piezoelectric driving section, wherein at a region of an end portion of the pressure generating chamber in a longitudinal direction, a portion of the substrate on a side of the vibration plate protrudes along the longitudinal direction into the pressure generating chamber in a shape of a step.

When the substrate supporting the vibration plate protrudes as convex portions at opposite ends of the pressure generating chamber in the longitudinal direction, two horn-like peaks of displacements generated at opposite ends of the vibration plate in the longitudinal direction can be suppressed by the convex portions.

Especially in a constitution in which a width of the pressure generating chamber is decreased in order to realize a high resolution, the vibration plate needs to be thinned in order to secure a sufficient vibration plate displacement. Even in this case, the crack of the vibration plate is prevented to extend the life, and the sufficient discharge life can be secured.

Moreover, when a BOX layer of an SOI substrate is constituted as an etching stop layer, it is possible to make uniform a film thickness of the vibration plate between adjacent elements and flatten the vibration plate in one element. In consequence, fluctuations of the displacement amount between the elements can be reduced.

Further features of the present invention will become apparent from the following description of exemplary embodiments with reference to the attached drawings.

BRIEF DESCRIPTION OF THE DRAWINGS

FIG. 1A is a sectional view of a separate liquid chamber in a short direction, and FIG. 1B is a sectional view in a longitudinal direction.

FIG. 7A is a sectional view of a separate liquid chamber in a short direction, and FIG. 7B is a sectional view in a longitudinal direction.

DESCRIPTION OF THE EMBODIMENTS

A best mode for performing the present invention will be described with reference to the drawings.

Example 1

Figure 1A:
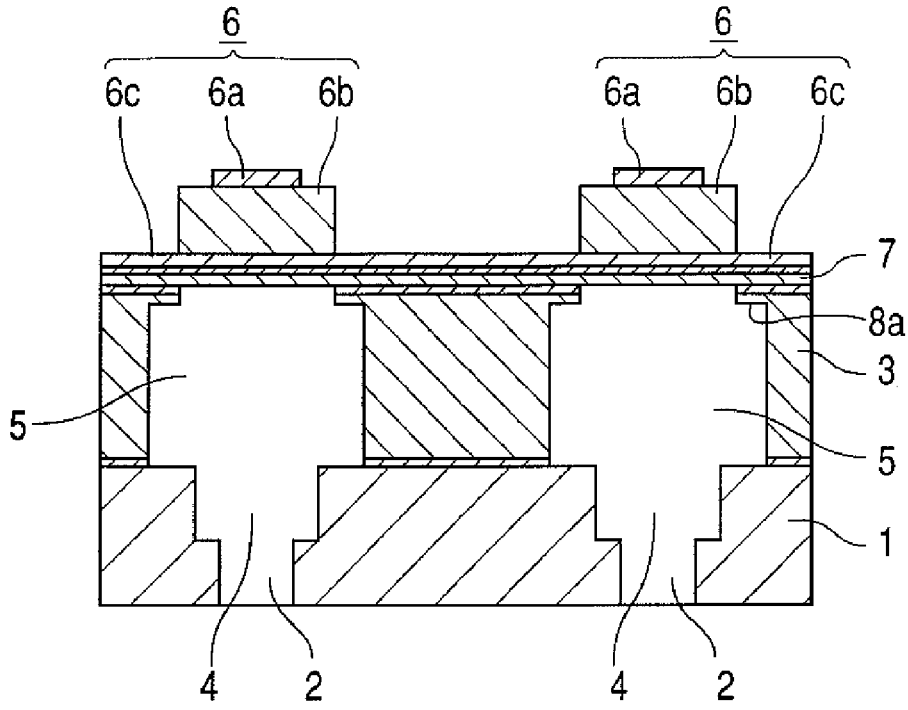
FIGS. 1A and 1B show a liquid discharge head according to Example 1.
Figure 1B:
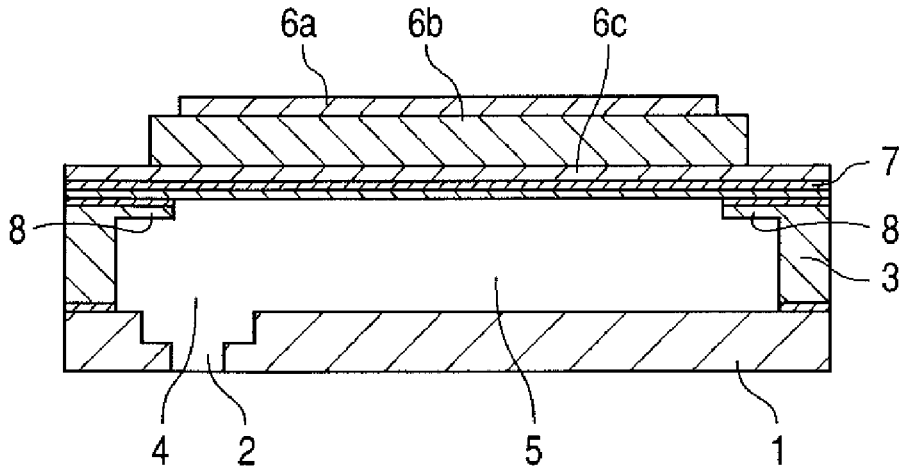

FIGS. 1A and 1B show a liquid discharge head according to Example 1. A nozzle plate 1 has discharge ports (nozzles) 2 for discharging liquid droplets, and a substrate 3 includes communication ports 4 which communicate with the discharge ports 2 and separate liquid chambers 5 which are pressure generating chambers. Each of piezoelectric driving sections 6 to generate pressures for discharging the liquid droplets has an upper electrode 6*a*, a piezoelectric film 6*b* and a lower electrode 6*c*, and pressurizes a liquid in each separate liquid chamber 5 via a vibration plate 7.

At opposite ends of the separate liquid chamber 5 in a longitudinal direction, as shown in FIG. 1B, portions (hereinafter referred to as "the convex portions") 8 for suppressing a displacement of the vibration plate 7 are arranged in a stepped state. That is, each portion of the substrate on a vibration plate side at a region of an end portion of the pressure generating chamber in the longitudinal direction protrudes along the longitudinal direction to the pressure generating chamber in the stepped state. In consequence, it is possible to control the displacement of the vibration plate 7 at the opposite end regions of the separate liquid chamber in the longitudinal direction owing to an increase of a displacement amount of the piezoelectric driving section 6 or a drop of a driving voltage, and a peculiar displacement behavior of the vibration plate at this region can be suppressed. In the present invention, since the convex portion is displaced together with the vibration plate while suppressing the displacement of the plate, the portion has a thickness of preferably 5 μm or less, more preferably 3 μm or less. In the present example, the convex portion has a thickness of 3 μm.

It is to be noted that in the present example, as shown in FIG. 1A, convex portions 8*a* for suppressing the displacement of the vibration plate 7 are also arranged at opposite ends of the separate liquid chamber 5 in a short direction in a stepped state. In consequence, a similar effect can be produced also in the short direction of the separate liquid chamber 5.

In the present example, since the convex portion protrudes to the pressure generating chamber in the stepped state, a space of the pressure generating chamber enlarges as compared with a case where the portion does not have any stepped state. As a result, there is also produced an effect that bubbles do not easily reside in the pressure generating chamber.

Figure 2A:
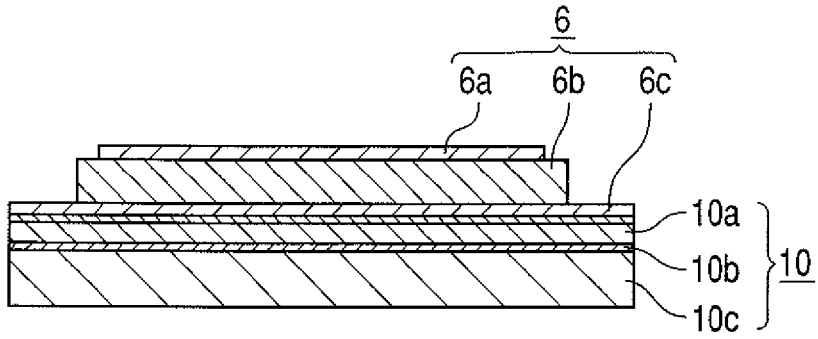
FIGS. 2A, 2B and 2C are diagrams showing a part of manufacturing steps of the liquid discharge head of FIGS. 1A and 1B.

The liquid discharge head of the present example is prepared by the following steps. As shown in FIG. 2A, an SOI substrate 10 is prepared in which a device layer 10*a* has a thickness of 6 μm, a buried oxide (BOX) layer 10*b* has a thickness of 0.5 μm and a handle layer 10*c* has a thickness of 200 μm. The SOI substrate 10 may have an arbitrary layer film thickness, and oxide films may be formed on the surfaces of the device layer 10*a* and the handle layer 10*c*.

The lower electrode 6*c* and the piezoelectric film 6*b* of the piezoelectric driving section 6 are formed on the device layer 10*a* of the SOI substrate 10, respectively, by a sputtering process. As the lower electrode 6*c*, a film of Ti/Pt is formed in a thickness of 30/300 nm, but an electrode material and an electrode film thickness are not limited to those of this example. As the piezoelectric film 6*b*, $Pb(Zr, Ti)O_3$ perovskite oxide (PZT) constituted of lead, titanium and zirconium is formed into a 3 μm film by the sputtering process. To obtain a satisfactory piezoelectric property, the PZT thin film is formed so as to achieve a composition of $Pb(Zr_{0.52}Ti_{0.48})O_3$. The composition of the PZT film is not necessarily limited to the above composition, and another composition may be constituted. The thickness of the PZT film may arbitrarily be determined in order to realize a desired performance.

Next, after removing the SOI substrate 10 having the piezoelectric film 6*b* formed thereon from a sputtering unit, the substrate is fired in an oxygen atmosphere at 700° C., and the PZT film is crystallized.

Subsequently, as the upper electrode 6*a*, a film including 30 nm of Ti and 300 nm of Pt is formed. Here, an electrode material and an electrode film thickness are not limited to the above conditions in the same manner as in the lower electrode.

Subsequently, the piezoelectric film 6*b* and the upper electrode 6*a* are processed by etching so as to constitute each separate liquid chamber 5. First, a photo resist is disposed on the upper electrode 6*a*. After patterning, the upper electrode 6*a* is processed by dry etching. Patterning and etching of the piezoelectric film 6*b* are similarly performed. Subsequently, a part of a liquid supply port (not shown) is formed by dry etching of the lower electrode 6*c* in the same manner as in the upper electrode 6*a* and Si dry etching of the device layer 10*a*, and the piezoelectric driving section 6 is formed which is a piezoelectric device.

Figure 2B:
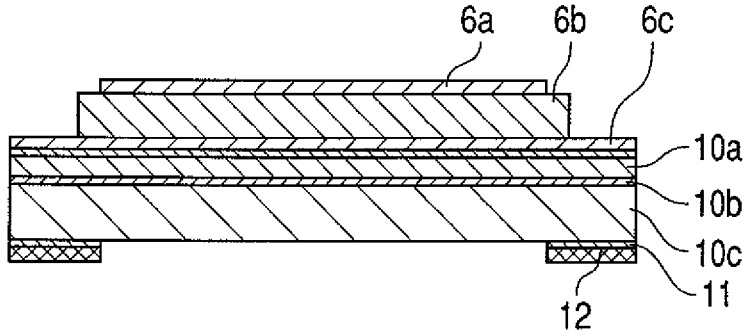
Figure 2C:
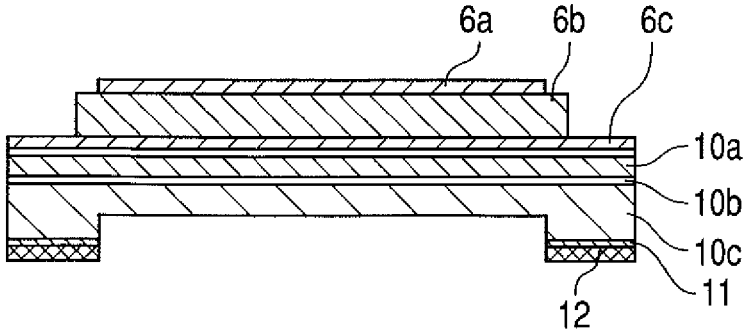

Next, a channel such as the separate liquid chamber 5 is formed in the handle layer 10*c* by use of an inductively coupled plasma (ICP) etching unit. First, as shown in FIG. 2B, an oxide film 11 constituting an etching mask and having a thickness of 2 μm is formed on the surface of the handle layer 10*c*. Furthermore, a resist pattern 12 is formed so as to constitute the convex portions 8 at opposite ends of the vibration plate 7, and the oxide film 11 is etched. Subsequently, as shown in FIG. 2C, Si of the handle layer 10*c* is processed as much as 3 μm by ICP etching.

Figure 3A:
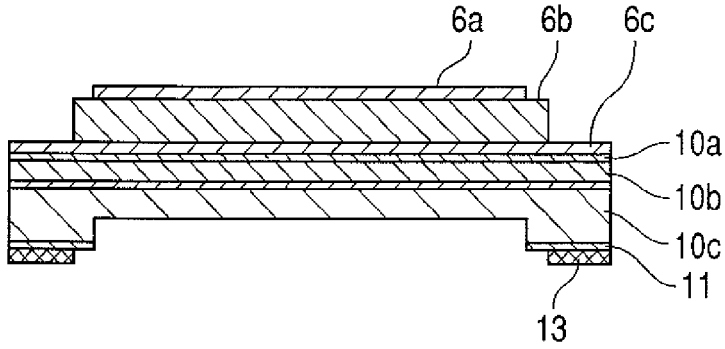
FIGS. 3A, 3B and 3C are diagrams showing a part of the manufacturing steps of the liquid discharge head of FIGS. 1A and 1B.
Figure 3B:
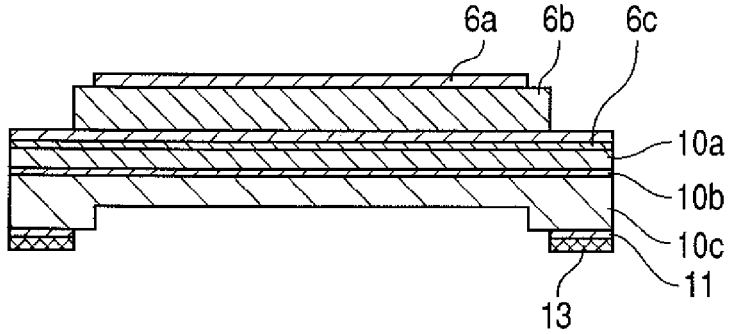
Figure 3C:
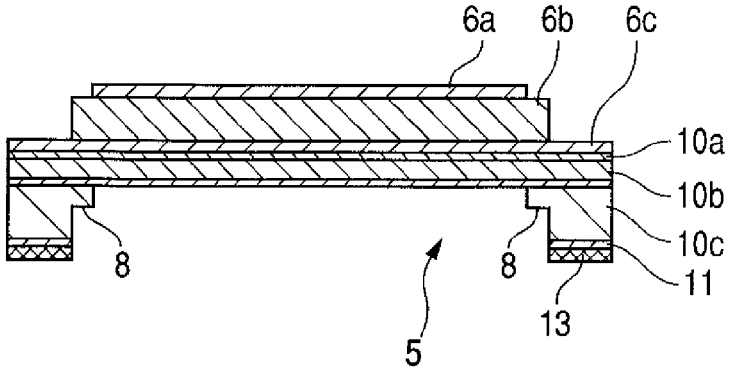

Next, after peeling the resist pattern 12, as shown in FIGS. 3A, 3B and 3C, a resist pattern 13 is formed again so as to obtain a separate liquid chamber shape. After etching the oxide film 11, Si of the handle layer 10*c* is processed by the ICP etching, and portions other than portions constituting the convex portions 8 at the opposite ends of the vibration plate are allowed to reach the BOX layer 10*b*.

Figure 4A:
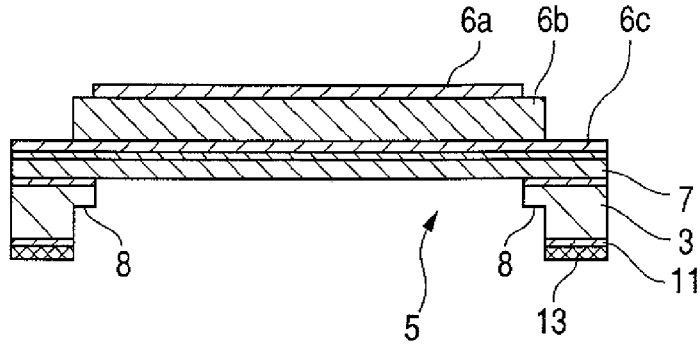
FIGS. 4A and 4B are diagrams showing a part of the manufacturing steps of the liquid discharge head of FIGS. 1A and 1B.
Figure 4B:
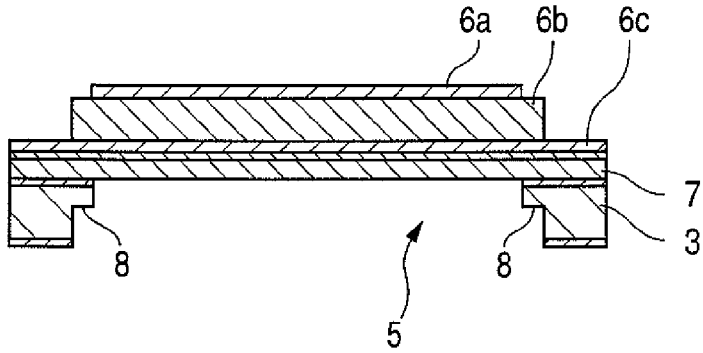

Subsequently, an $SiO_2$ film which is the BOX layer 10*b* is peeled by buffered hydrofluoric acid. As shown in FIG. 4A, there is exposed the vibration plate 7 which is constituted of the handle layer 10*c* and which faces the separate liquid chamber 5. Furthermore, as shown in FIG. 4B, the resist pattern 13 is peeled.

A width of the separate liquid chamber 5 was set to 100 μm, and a length thereof was set to 2.5 mm, but, needless to say, the present invention is not limited to this example.

Finally, a 200 μm wafer constituting the nozzle plate 1 is subjected to the ICP etching from the opposite surfaces, the communication port 4, the discharge port 2 and the like are formed, and this nozzle plate 1 is bonded to the substrate 3 to thereby prepare a piezoelectric ink jet head.

At this time, the nozzle plate 1 may be processed by another technique, or constituted by laminating several plates.

Figure 5:
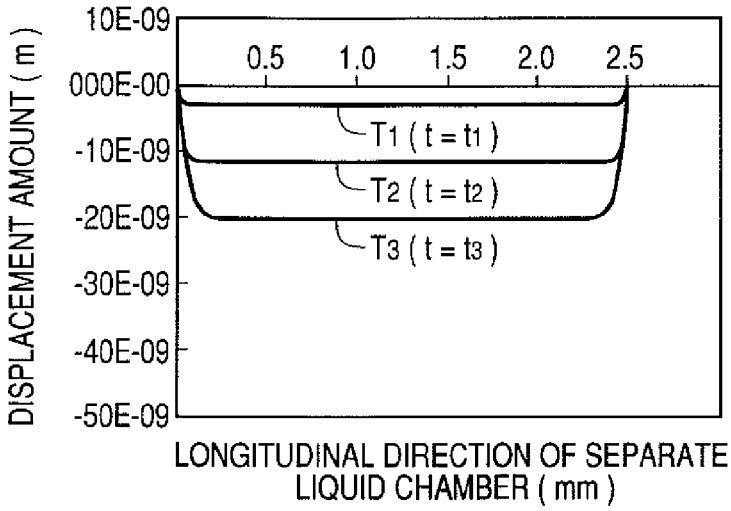
FIG. 5 is a graph showing a deformation mode of a vibration plate in the liquid discharge head of FIGS. 1A and 1B.

According to the present example, as shown in FIG. 5, it is possible to control two horn-like peaks of a displacement shape of the vibration plate 7 at the opposite ends of the separate liquid chamber in the longitudinal direction.

In the step of bonding the nozzle plate including the discharge ports formed in the Si substrate to the SOI substrate provided with the piezoelectric driving sections and the separate liquid chambers to manufacture the liquid discharge head, the BOX layer constituted of the $SiO_2$ film on the SOI substrate is an etching stop layer in forming the convex portions of the vibration plate. In consequence, the convex portions at the opposite ends of the vibration plate and the vibration plate are formed in precise thicknesses, respectively, the displacement amount between the elements can be made uniform, and the life of the vibration plate can be averaged. A ratio between the thickness of the vibration plate and the thickness of each convex portion can be changed to arbitrarily control the displacement of the vibration plate.

Example 2

Figure 6:
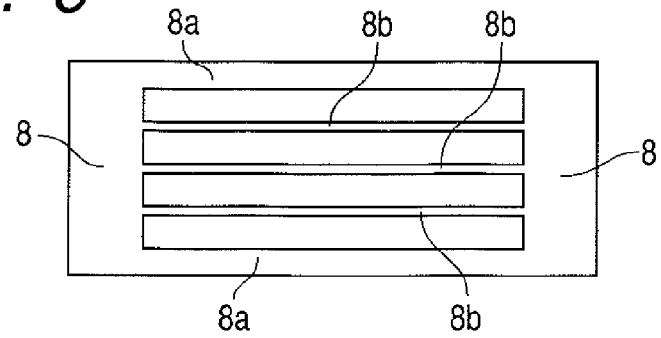
FIG. 6 is a diagram showing a convex portion and rib-like members according to Example 2.
Figure 7A:
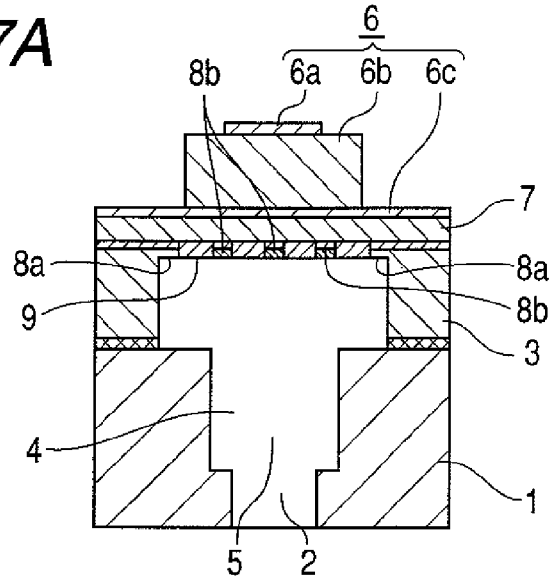
FIGS. 7A and 7B show a liquid discharge head according to Example 2.
Figure 7B:
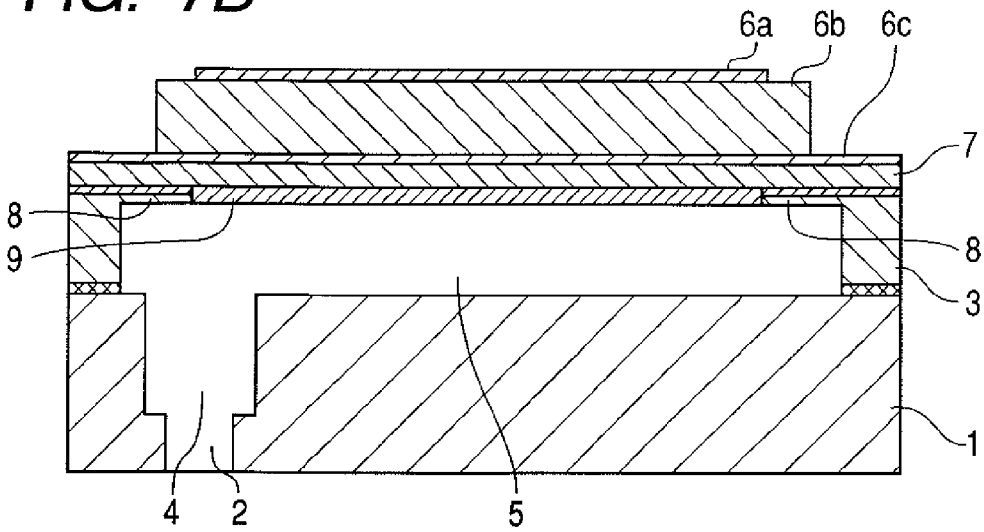
Figure 8:
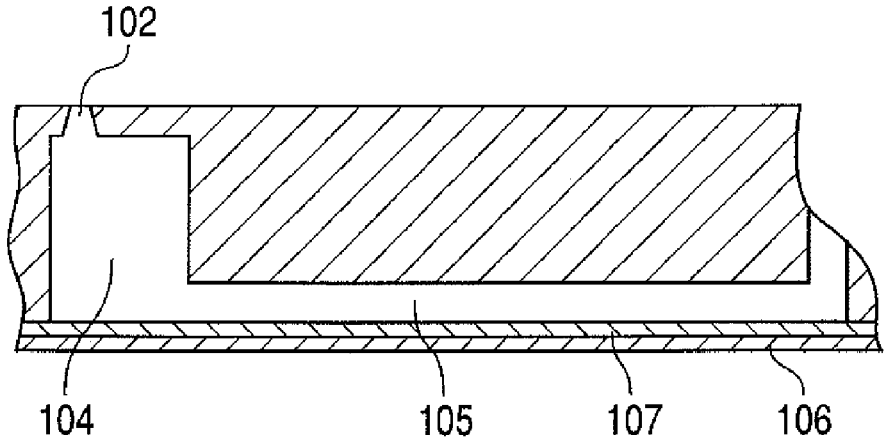
FIG. 8 is a sectional view showing one conventional example.
Figure 9:
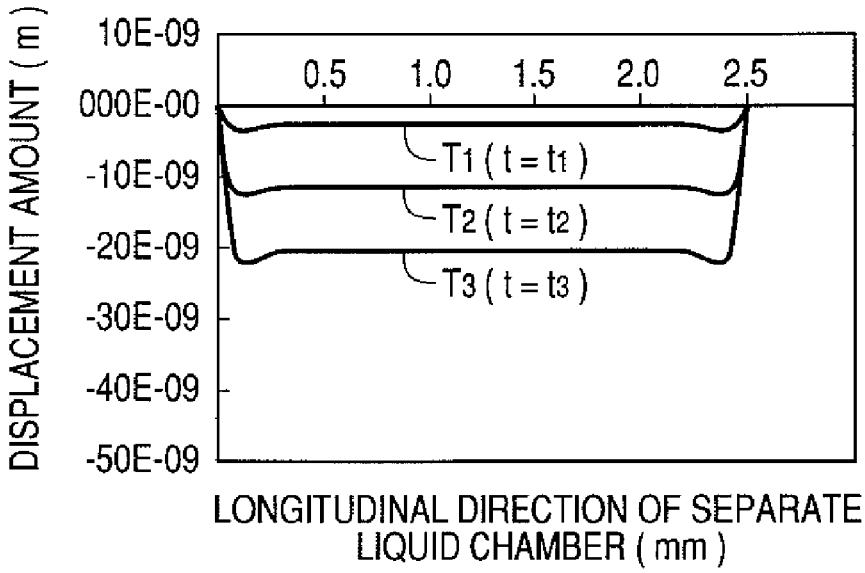
FIG. 9 is a graph showing a deformation mode of a vibration plate in the conventional example.

As shown in FIGS. 6, 7A and 7B, in the present example, rib-like members 8*b* extending in a longitudinal direction of a separate liquid chamber 5 are added to the vibration plate 7 of Example 1 to form grooves in the longitudinal direction. A step of forming an upper electrode, a piezoelectric article and a lower electrode on an SOI substrate to perform patterning and a step of bonding the substrate to a nozzle plate are similar to those of Example 1. Since each rib-like member is displaced together with the vibration plate, the member has a thickness of preferably 5 μm or less, further preferably 3 μm or less. In the present example, the rib-like member has a thickness of 3 μm.

The separate liquid chamber 5 is formed by a step similar to the above-described step by use of the SOI substrate including a handle layer having a thickness of 100 μm. Subsequently, an elastomer resin is poured into a groove between the rib-like members 8*b* and hardened to form a protective layer 9 which covers a flat surface of the vibration plate 7.

There is not any special restriction on a material forming the protective layer 9 as long as the Young's modulus of the material is sufficiently lower than that of the vibration plate 7, but a silicone resin, an epoxy resin, an acrylic resin or the like is preferably usable.

In the present example, with an elapse of time during liquid discharge, bubbles accumulated in a boundary between the vibration plate 7 and each convex portion 8 can efficiently be removed. In consequence, it is possible to suppress non-discharge of the bubbles and a drop of displacement amount. In addition, since the SOI substrate including the thinned handle layer constituting the vibration plate 7 is used, a depth of the separate liquid chamber 5 and an aspect ratio between widths of the vibration plate 7 and the separate liquid chamber 5 in the short direction are decreased, and the liquid discharge head having a higher processing precision can be provided.

Comparative Example

A liquid discharge head according to a comparative example was prepared in which convex portions or rib-like members were omitted from each of the constitutions according to Examples 1, 2, and a rectangular voltage waveform was supplied to repeat a liquid discharge operation.

As a result, the life lengthened in Examples 1, 2 as compared with the comparative example. That is, history data of displacement of the surface of the piezoelectric driving section with time were taken from several points of the separate liquid chamber in the longitudinal direction by use of a non-contact displacement meter. As a result, two horn-like peaks generated at the opposite ends of the separate liquid chamber in the longitudinal direction were suppressed. In consequence, it has been considered that any strict bend is not added, and the life extends.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-008146, filed Jan. 17, 2006, which is hereby incorporated by reference herein in its entirety.

What is claimed is:

1. A liquid discharge head comprising:

a vibration plate provided with a piezoelectric driving section, the vibration plate including a device layer of an SOI substrate;

a substrate which supports the vibration plate, the substrate defining a pressure generating chamber communicating with a discharge port to discharge liquid, the pressure generating chamber arranged to correspond to the piezoelectric driving section, at a region of an end portion of the pressure generating chamber in a longitudinal direction, a portion of the substrate on a side of the vibration plate protrudes along the longitudinal direction into the pressure generating chamber in a shape of a step, and the substrate including a handle layer of the SOI substrate; and rib-like members formed on the substrate and extending in the longitudinal direction of the pressure generating chamber, a gap between the rib-like members being filled with a material having a Young's modulus which is smaller than that of a material constituting the vibration plate.

2. The liquid discharge head according to claim 1, wherein the portion of the substrate has a thickness of 5 μm or less.

3. The liquid discharge head according to claim 1, wherein the portion of the substrate is also disposed at a region of an end portion of the pressure generating chamber in a direction transverse to the longitudinal direction.

4. A manufacturing method of the liquid discharge head according to claim 1, wherein when the pressure generating chamber is formed in the substrate by etching, a BOX layer of the SOI substrate is used as a stop layer of the etching.

* * * * *